US009943179B1

(12) United States Patent
May et al.

(10) Patent No.: US 9,943,179 B1
(45) Date of Patent: Apr. 17, 2018

(54) UPRIGHT SLEEP SYSTEM

(71) Applicant: SnoozeWell, LLC, Nashville, TN (US)

(72) Inventors: Julie Anna May, Nashville, TN (US); Christopher Miller Howard May, Nashville, TN (US)

( * ) Notice: Subject to any disclaimer, the term of this patent is extended or adjusted under 35 U.S.C. 154(b) by 0 days.

(21) Appl. No.: 15/378,344

(22) Filed: Dec. 14, 2016

(51) Int. Cl.
*A47G 9/10* (2006.01)
*A47C 7/38* (2006.01)

(52) U.S. Cl.
CPC ..... *A47G 9/1027* (2013.01); *A47C 7/38* (2013.01); *A47G 9/1063* (2013.01); *A47G 9/1081* (2013.01); *A47G 2009/1018* (2013.01)

(58) Field of Classification Search
CPC .. A47C 7/36; A47C 7/38; A47C 7/383; A47C 7/40; A47C 7/42; A47C 7/425; A47C 7/467; A47G 9/10; A47G 9/1027; A47G 9/1045; A47G 9/1072; A47G 2009/1018; A47G 9/1081; A47G 9/1063
See application file for complete search history.

(56) References Cited

U.S. PATENT DOCUMENTS 1,200,858 A * 10/1916 Linder ..... B63C 9/115 441/115
1,890,358 A 12/1932 Barcalo
2,734,556 A * 2/1956 Hebrank ..... A47C 7/021 160/232
2,952,856 A * 9/1960 Ruff ..... A47G 9/10 297/391
3,848,281 A * 11/1974 Mathews ..... A47G 9/10 5/490
3,883,906 A * 5/1975 Sumpter ..... A47G 9/10 5/632
4,193,150 A 3/1980 Vineberg
4,274,673 A * 6/1981 Kifferstein ..... A47C 7/383 297/220
4,320,543 A 3/1982 Dixon
4,345,345 A * 8/1982 Holtz ..... A47C 7/383 5/640
D266,549 S 10/1982 Lund, III
4,635,306 A 1/1987 Willey
D289,354 S 4/1987 Willey
(Continued)

OTHER PUBLICATIONS

U.S. Appl. No. 29/587,572, filed Dec. 14, 2016, SnoozeWell, LLC.

*Primary Examiner* — Robert G Santos
*Assistant Examiner* — David R Hare
(74) *Attorney, Agent, or Firm* — Waller Lansden Dortch & Davis, LLP; Matthew C. Cox

(57) ABSTRACT

An upright sleep system includes a base pillow and a top pillow. The base pillow includes a tapered shape, including a top edge having a top edge thickness and a bottom edge having a bottom edge thickness less than the top edge thickness. A user may rest his or her head against the top pillow or base during use, and the base pillow supports both the top pillow and the user's torso and arms. By utilizing the upright sleep system the users head, neck, chin, torso and arms can all be supported. The base pillow and tether provide a stable support for the top pillow to prevent the top pillow from becoming dislodged while the user rests. A base passage in the base pillow is shaped to receive a user's arm or arms to further enhance comfort and support. In some embodiments, the base and top pillow include an inflatable, airtight chamber.

3 Claims, 12 Drawing Sheets

(56) References Cited

U.S. PATENT DOCUMENTS

D289,481 S 4/1987 Reddick
D295,248 S 4/1988 Sommerfield et al.
4,768,246 A * 9/1988 Summer ..... A47G 9/10 5/636
4,956,886 A * 9/1990 Sarkozi ..... A47G 9/10 5/636
5,020,174 A * 6/1991 Sarkozi ..... A47G 9/10 5/640
D318,392 S 7/1991 Edelson
D319,365 S 8/1991 Edelson
D327,198 S 6/1992 Erker, Jr. et al.
5,182,828 A * 2/1993 Alivizatos ..... A47C 20/025 5/631
D336,134 S 6/1993 Kalatsky
5,269,323 A * 12/1993 Krouskop ..... A47C 20/021 5/632
5,297,848 A * 3/1994 Grinnell ..... A47C 7/425 297/219.1
D371,462 S 7/1996 Grossmith
D375,989 S 11/1996 Jacobs
5,611,601 A * 3/1997 Cowgur ..... A47C 7/383 297/393
D390,298 S 2/1998 Ince et al.
D392,495 S 3/1998 Baousson
D398,181 S 9/1998 Lange et al.
5,864,904 A * 2/1999 Rudick ..... A47G 9/1054 5/490
D406,210 S 3/1999 Johnson
D406,718 S 3/1999 Jacobs
D407,259 S 3/1999 Jackson
5,907,876 A * 6/1999 Schwabe ..... A47G 9/10 5/636
D416,428 S 11/1999 Jackson
5,978,990 A * 11/1999 Akey ..... A47C 20/021 5/631
6,041,458 A * 3/2000 Vickers ..... A47G 9/10 5/490
6,266,832 B1 * 7/2001 Ezell ..... A47G 9/10 297/219.12
D446,676 S 8/2001 Mayes
D452,404 S 12/2001 Cameron
6,560,800 B1 * 5/2003 Draves ..... A47C 20/027 5/630
6,795,990 B1 * 9/2004 Hutchinson ..... A47C 20/021 5/490
6,931,683 B1 8/2005 Elkin et al.
D509,269 S 9/2005 Decker
6,973,691 B1 12/2005 Cordova et al.
D539,066 S 3/2007 Coquillette
D547,586 S * 7/2007 Weiss-Lohrei ..... D6/601
7,252,330 B2 * 8/2007 Lincoln ..... A47C 7/383 297/219.12
7,322,057 B2 1/2008 Merlini
D583,180 S * 12/2008 Haile ..... D6/601
D587,507 S 3/2009 Martin
D592,753 S 5/2009 Jacinto
D610,852 S 3/2010 Rothschild et al.
7,788,751 B1 * 9/2010 Diemer ..... A47C 7/383 297/391
7,788,752 B2 * 9/2010 Tidwell ..... A47C 16/00 5/632
D627,113 S 11/2010 Seliskar
D634,568 S 3/2011 Fischnaller
D635,265 S 3/2011 Coffey et al.
7,958,582 B1 6/2011 Scamardo
D642,278 S 7/2011 Sharps et al.
D651,368 S 12/2011 Seliskar et al.
D651,840 S 1/2012 Davis, III
D655,559 S 3/2012 Cheng
D656,356 S 3/2012 Cheng
8,276,227 B2 * 10/2012 Pileggi ..... A47G 9/1081 5/630
8,333,308 B2 * 12/2012 Maginness ..... A45F 3/04 224/153
D674,644 S 1/2013 Stewart
8,448,275 B1 * 5/2013 Leach ..... A47C 20/027 297/284.5
8,479,334 B1 * 7/2013 Leach ..... A47D 13/08 5/652
8,814,106 B2 8/2014 Aguilera
D718,074 S 11/2014 Savolainen
8,931,127 B1 1/2015 Moses
D732,174 S 6/2015 Johnson et al.
D732,312 S 6/2015 Tiffin
D733,897 S 7/2015 Rossouw
D734,545 S 7/2015 Cantu et al.
9,101,223 B2 8/2015 Walker
D739,668 S 9/2015 Owens
9,173,501 B1 11/2015 Garner
9,186,003 B2 11/2015 Hsu
D749,862 S 2/2016 Polk-Kuku
9,259,091 B2 2/2016 Freund
9,307,842 B2 * 4/2016 Gibbons ..... A47C 20/025
D755,539 S 5/2016 Schueth
D762,400 S 8/2016 Wong
9,427,087 B2 8/2016 Clarke et al.
D766,015 S 9/2016 Walker
9,481,277 B1 11/2016 Ruelas
9,498,056 B1 11/2016 Mills et al.
D778,373 S 2/2017 Gossett
2001/0044968 A1 11/2001 Schmitter et al.
2004/0123390 A1 7/2004 Takizawa
2005/0172408 A1 8/2005 Temple
2006/0080780 A1 4/2006 Schlieps
2007/0052274 A1 * 3/2007 Morphew ..... B60N 2/2851 297/392
2007/0204402 A1 * 9/2007 Harris ..... A47D 13/08 5/655
2009/0007336 A1 1/2009 Kassai et al.
2010/0262050 A1 10/2010 Gasparovich
2013/0341367 A1 12/2013 Purpura et al.
2014/0189956 A1 7/2014 Sosi
2015/0335180 A1 * 11/2015 Wagner ..... A47G 9/1063 5/638
2016/0192794 A1 7/2016 Boyd
2017/0119624 A1 5/2017 Kim
2017/0173297 A1 6/2017 Park et al.

* cited by examiner

UPRIGHT SLEEP SYSTEM

BACKGROUND

The present invention relates generally to devices and methods for aiding in sleep, and more particularly to pillows and associated items for aiding in sleep while seated in an upright position.

Pillows are commonly used to aid in sleep, rest and rehabilitation in numerous settings such as but not limited to at home, hospitals or during any mode of transit for travel, and during and after medical procedures and for chronic medical ailments. In many circumstances, people travelling or with short term, long term or chronic medical conditions are required to remain in an upright or semi-upright position sitting in a seat, on a chair, or in a bed for extended periods of time. Prolonged periods of sitting in the same spot are generally not conducive to getting quality sleep. Such prolonged periods of sitting upright may be experienced during travel on an airplane, train, bus, automobile or any other mode of transport. Similarly, prolonged periods of sitting upright may also be required during or after medical procedures such as shoulder surgery, various types of plastic surgery, sinus surgery, orthopedic surgery or eye surgery. Additionally, sleeping or sitting in an upright position may be a prescribed treatment for numerous medical conditions such as sleep apnea, digestive issues, irritable bowel syndrome, vertigo, acid reflux and multiple other conditions.

Achieving quality sleep while sitting in an upright or semi-upright position is difficult for most individuals. Users typically attempt to use a pillow or other soft cushion to support the head, neck, chin and/or arms while attempting to sleep upright. However, conventional pillows do not resize, lack firmness and are difficult to position in such a way that they provide the right amount of support to the head, neck, chin torso and arms to allow quality sleep. Additionally, conventional pillows are too large and bulky to be feasible or practical for use for many modes of travel and in many medical applications.

Others have recognized the difficulties associated with sleeping in an upright position and have developed modified pillows and cushions to attempt to overcome the problems of conventional pillows. For example, numerous travel and medical pillow devices are available. Such devices for travel are generally more compact than conventional pillows and may be shaped to fit around a user's neck or shoulder to provide head and neck support. However, these conventional travel pillows are generally uncomfortable and fail to provide adequate support for the head, neck and chin much less the arms and torso. This often leads to users nodding or generally being unable to achieve a comfortable position for sleeping using such devices. Medical pillows may lift the head up, but generally do not address semi elevated and fully upright posture or support the head and neck.

Conventional travel and medical pillows may become unsanitary as they often do not include any interchangeable exterior that can be taken off and cleaned. Conventional travel pillows are also often arranged in odd shapes and configurations, leading to users feeling as if they look ridiculous when using them. In sum, conventional travel pillow devices do not provide adequate head, neck, chin, arm and torso support when a user is sitting in an upright position that allow the user to sleep and without feeling that the device creates an odd personal appearance.

What is needed, then are improvements in devices used for aiding in situations rest and sleep are needed for a prolonged period when a user is seated in an upright or semi-upright position.

BRIEF SUMMARY

The present invention generally provides an upright sleep system including a base pillow and a top pillow. The base pillow includes a passage defined through the base pillow allowing passage of a user's hand or arm. The top pillow may be adjusted to take various shapes, based on the user's preference, including a regular rectangular shape or a bow-tie shape. A tether selectively connects the top pillow and base pillow to prevent the top pillow from being lost or from falling onto the floor or ground during use, moving positions or during transport.

In some embodiments, the present invention provides an upright sleep system including a pliable top pillow and a base pillow. The base pillow provides a stable support for the top pillow head, neck and chin, as well as the torso and arms, such that the top pillow doesn't fall away from the user's body when the user is sleeping. The base pillow, when inflated, includes a trapezoidal profile when viewed from the side in some embodiments. Alternatively, the malleable base pillow may include a substantially rectangular profile. Both the base and top pillow may include a cushion material to provide comfort and support to a user based on their preference of sleeping position. Such cushion material may include any suitable filler including but not limited to a foam material, an open-cell foam, a closed cell foam, a memory foam, textile material, beads, feathers, natural fibers, artificial fibers, or other suitable filler materials. This may be part of the pillow, or the pillows may have a layer of this cushion material.

In further embodiments, the present invention provides an upright sleep system including a top pillow and a base pillow, wherein the top pillow and/or base pillow are inflatable. In such embodiments a valve is disposed on each pillow to allow a user to selectively inflate or deflate the pillow to adjust to the size of the user and the position of the pillows. Each pillow may be self-inflating in some embodiments. In additional embodiments, as self-expanding filler material is disposed inside the top pillow or bottom pillow to provide additional ease of inflation and comfort to the user.

An additional feature of the upright sleep system includes a tether between the top pillow and base pillow to prevent the top pillow from falling onto the floor or ground during use, moving positions or during transport. Additionally, the top pillow and base pillow each may include an interchangeable pillow case to be used as a cover. The top pillow case may be reversed or removed to be cleaned or to change the appearance or texture of the top pillow. The top and base pillowcases may have pockets for arms and storage in some embodiments. Similarly, the base pillow case may be removed to be cleaned or to change the appearance or texture of the base pillow. An external storage bag may also be included to house the top pillow, base pillow, pillow cases and other accessories during storage or during transport.

In additional embodiments, base pillow and/or top pillow may serve as flotation devices during emergency situations such as during air travel.

Numerous other objects, features and advantages of the present invention will be readily apparent to those skilled in the art upon a reading of the following disclosure when taken in conjunction with the accompanying drawings.

DETAILED DESCRIPTION

Figure 1:
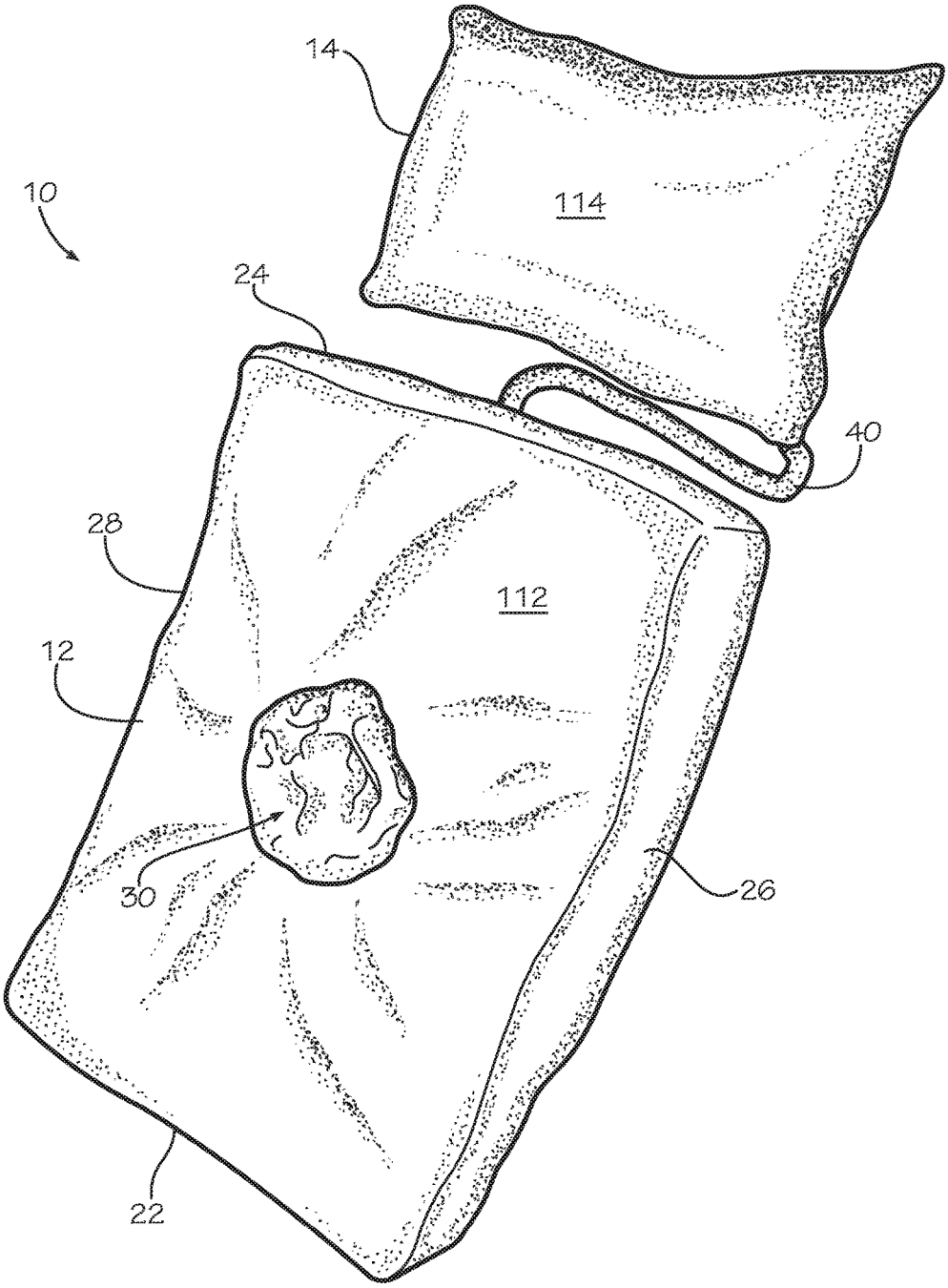
FIG. 1 illustrates a perspective view of an embodiment of an upright pillow system in accordance with the present disclosure.

Referring now to the drawings, various views of embodiments of an upright pillow system and components therefor are illustrated. In the drawings, not all reference numbers are included in each drawing, for the sake of clarity. In addition, positional terms such as "upper," "lower," "side," "top," "bottom," "vertical," "horizontal" etc. refer to the apparatus when in the orientation shown in the drawings or similar orientations. A person of skill in the art will recognize that the apparatus can assume different orientations when in use.

An embodiment of an upright pillow system 10 is shown in FIG. 1. Upright pillow system 10 includes a base pillow 12 and top pillow 14. Base pillow 12 is generally larger than top pillow 14, and base pillow 12 provides a support for a user to position top pillow 14 against during use. Base pillow 12 and top pillow 14 are used in combination to provide numerous support configurations. Base pillow 12 generally provides a support on which top pillow may be positioned. Depending on the seating configuration of the user, top pillow 14 may be arranged in many different positions to provide optimal support and comfort to a user. Base pillow 12 has a flat platform region 16 located on the base pillow upper edge 24, shown in FIG. 3. Top pillow 14 is generally placed against platform region 16.

Figure 18:
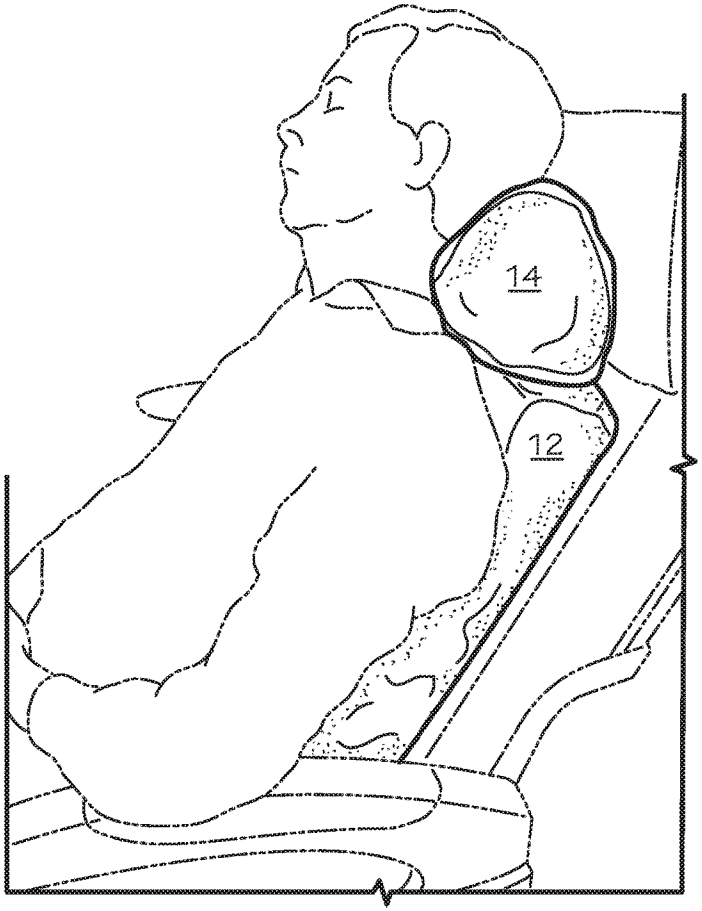
FIG. 18 illustrates a perspective view of an embodiment of an upright pillow system in use by a user in accordance with the present disclosure.
Figure 24:
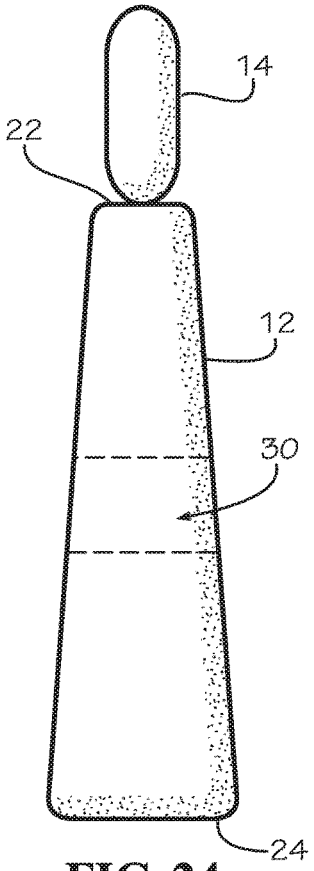
FIG. 24 illustrates a side view of an embodiment of an upright pillow system in accordance with the present disclosure.
Figure 25:
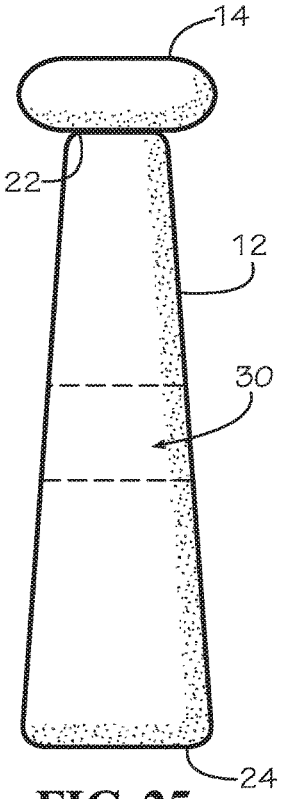
FIG. 25 illustrates a side view of an embodiment of an upright pillow system in accordance with the present disclosure.

Alternatively, in some applications it is desirable to orient base pillow 12 in an inverted embodiment, as shown in FIG. 18 and FIGS. 24 and 25. In these embodiments, top pillow 14 rests against the thinner side 22 of base pillow 12 and is oriented upwardly, and the thicker side 24 is oriented downwardly. Top pillow 14 rests against the thinner side 22 of base pillow 12 either in an upright orientation as seen in FIG. 24 or in a more flat orientation as seen in FIG. 25.

Figure 2:
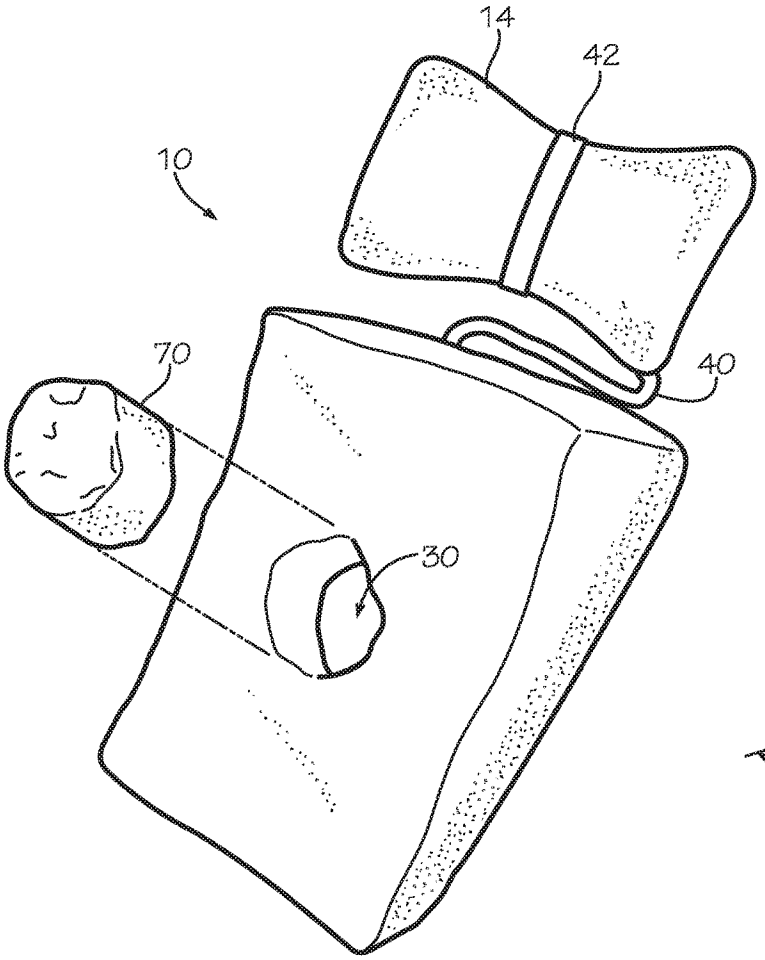
FIG. 2 illustrates a perspective view of an embodiment of an upright pillow system in accordance with the present disclosure.

Base pillow 12 and top pillow 14 are connected together using a tether 40, shown in FIG. 1 and FIG. 2. Tether 40 includes a connector that prevents top pillow 40 from being inadvertently dropped on the ground or floor during use, moving positions or during transport. Tether 40 may take many different shapes and sizes, and generally provides a length of material sufficient to provide a connection between top pillow 14 and base pillow 12. Tether 40 is selectively removable from base pillow 12 and/or from top pillow 14 using one or more tether connectors such as Velcro, magnets, snaps or buttons. In other embodiments, tether 40 may be secured to a base pillow case positioned over base pillow 12 at a first tether end, and secured to a top pillow case positioned over top pillow 14 at a second tether end that may be attached with Velcro, magnets, snaps or buttons or any other type of connective device.

Figure 3:
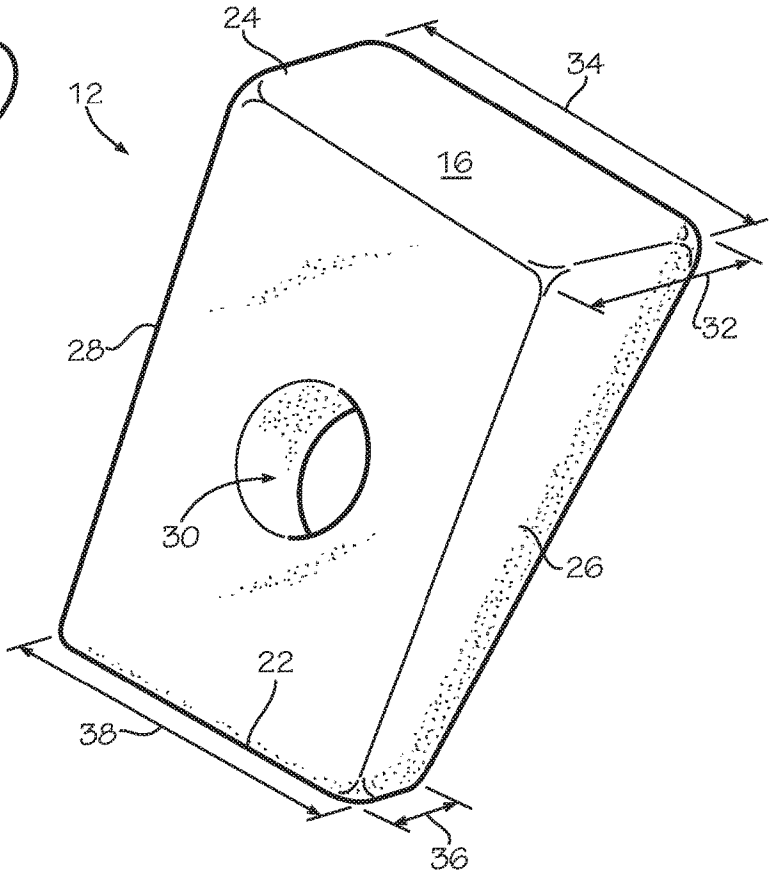
FIG. 3 illustrates a perspective view of an embodiment of a base pillow system in accordance with the present disclosure.

Referring further to the base pillow 12, as seen in FIG. 3, base pillow 12 includes a generally flat shape having a front and a back and includes a base lower edge 22, a base upper edge 24, a base first side edge 26 and a base second side edge 28. Upright pillow system 10 is shaped to allow for use in various semi reclined or upright seating configurations, including seating during travel and at home, hospital or work. As seen in FIG. 3, base pillow 12 includes a base lower edge 22 having a lower edge thickness 36 and a lower edge width 38. Similarly, base upper edge 24 includes an upper edge thickness 32 and an upper edge width 34. In some embodiments, lower edge width 38 is substantially equal to upper edge width 34. To form a desired shape, in some embodiments, upper edge thickness 32 is greater than lower edge thickness 36. The upper edge thickness 32 is approximately twice the lower edge thickness 36 in some embodiments fully expanded. Such a configuration provides a base pillow 12 having a first side edge 26 and second side edge 28 each having a generally trapezoidal shape.

By providing a lower edge thickness 36 less than upper edge thickness 32, the upright pillow system is readily adapted for use in various seating configurations. Seating configurations in airplanes, automobiles, buses, trains and other transportation generally provide a narrow space between a user's legs and adjacent armrests. The reduced lower edge thickness 36 allows the lower edge of base pillow 12 to be inserted between or on top of a user's leg and armrest of a seat or chair, as shown for example in FIG. 12 and FIG. 19. Dimensioning the upper edge thickness 32 greater than the lower edge thickness 36 allows a user to have adequate support at the upper end of the base pillow 12 while still being able to fit the lower edge 22 of the base pillow 12 in a narrow space in a close-quarters seating environment.

Figure 12:
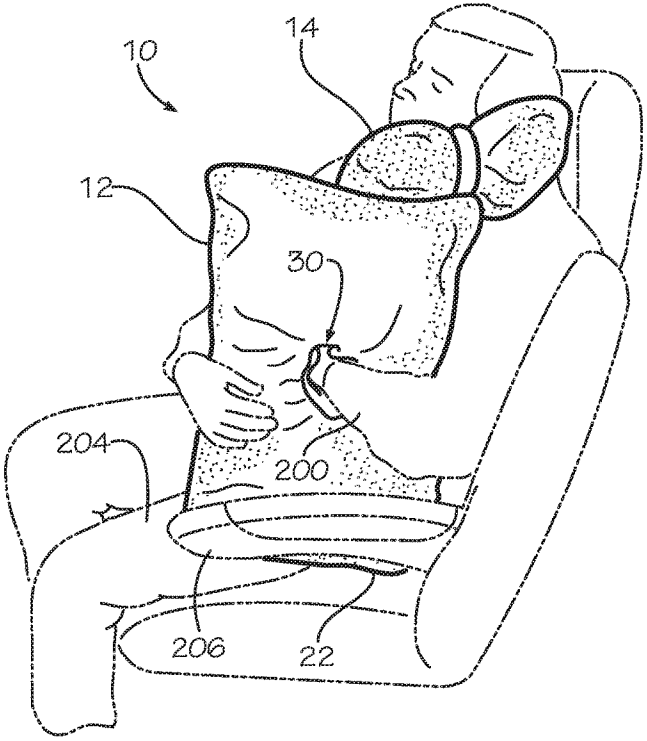
FIG. 12 illustrates a perspective view of an embodiment of an upright pillow system in use by a user in accordance with the present disclosure.
Figure 14:
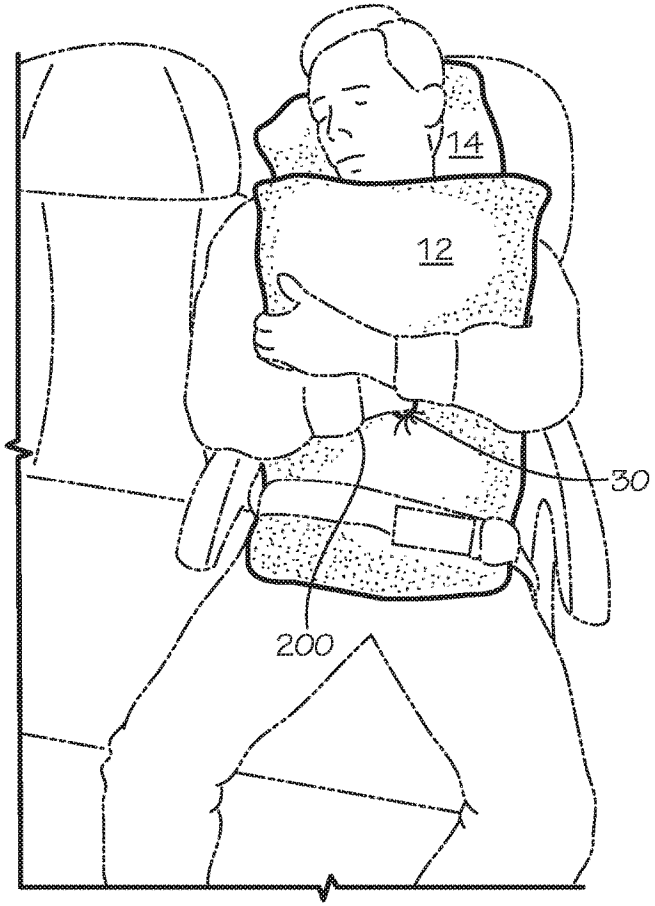
FIG. 14 illustrates a perspective view of an embodiment of an upright pillow system in use by a user in accordance with the present disclosure.

Referring further to the base pillow 12, a base passage 30 is defined in base pillow 12 from the front side to the back side in some embodiments. Base passage 30 provides an opening for a user to insert hand(s) or arm(s) during use. By providing a base passage 30 through base pillow 12, a user may be able to achieve a higher level of comfort as compared to conventional pillows that do not allow a user to pass a hand or arm through the pillow. Base passage 30 also allows a user to pass hand(s) or arm(s) through the pillow to secure the position of the base pillow 12 during use. This is important in many applications, as users tend to fall asleep and conventional travel and medical pillows will shift based on movement from the means of transportation or just movement by the user either traveling, in the hospital or at home or office. Base passage 30 allows a user to anchor the pillow in place to prevent base pillow 12 from shifting during prolonged use. For example, as shown in FIG. 12, a user's arm 200 is may be inserted into base passage 30 when base pillow 12 is positioned against the user's body. Extension of the user's arm 200 through base passage 30 provides both additional comfort to the user and also helps secure base pillow 12 in place to prevent either the base pillow 12 or the top pillow 14 from being accidentally dislodged while the user is asleep. As shown in FIG. 14 the base pillow can be secured by the seatbelt. As also shown in FIG. 12, the base lower edge 22 is shaped, dimensioned and pliable to be easily received between an armrest 206 and a user's leg 204 in a seating environment such as an airplane seat.

Figure 26:
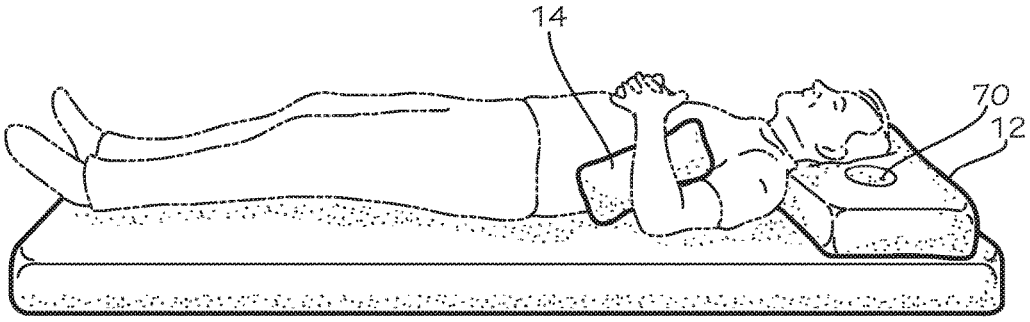
FIG. 26 illustrates a perspective view of an embodiment of a base pillow in use by a user in accordance with the present disclosure.

In some embodiments, a user may wish to block the base passage 30 during periods of non-use or during use in a horizontal position when it is not desired to use the base passage 30. A plug 70 is included with the upright sleep system 10 in some embodiments, as shown in FIG. 2. Plug 70 includes a plush material in a shape corresponding with the shape of base passage 30. Plug 70 may be inserted into base passage 30 to fill base passage 30, and may be removed by a user when usage of base passage 30 is desired. Additionally, when plug 70 is installed in base pillow 12, a user may use base pillow 12 lying a flat position, as seen in FIG. 26.

Top pillow 14 may include may different shapes in different embodiments, including a regular rectangular shape shown in FIG. 1, or a bow-tie shape as shown in FIG. 2. The bow-tie shape generally refers to a shape where the middle of the top pillow 14 is constricted to a reduced circumference, while the right and left sides of the top pillow 14 have a slightly larger circumference. The bow-tie shape provides additional comfort to a user when resting their face, head, chin or neck against the top pillow 14 during sleep. A cinch 42 may be disposed on top pillow 14 in some embodiments, as seen In FIG. 2, to allow a user to adjust the constriction of the top pillow 14. Cinch 42 may take many different forms, including a drawstring, strap, buckle or other suitable mechanism for cinching the middle region of top pillow 14. In other embodiments, top pillow 14 includes the shape of a regular rectangular or ellipsoidal solid.

Another advantage of the present upright sleep system is the interchangeability of coverings on the top pillow 14 and base pillow 12. For example, as shown in FIGS. 4-7, top pillow 14 may include an interchangeable top pillow case 114. Top pillow case 114 includes a soft textile material to provide comfort to a user during use. Top pillow case 114 includes a top pillow case opening 116 shaped to receive top pillow 14. Top pillow case opening 116 may be selectively closed after top pillow 14 is inserted into top pillow case 114. Top pillow case 114 is dimensioned slightly larger than top pillow 14 to provide room for top pillow case 114 to surround and enclose top pillow 14.

Figure 4:
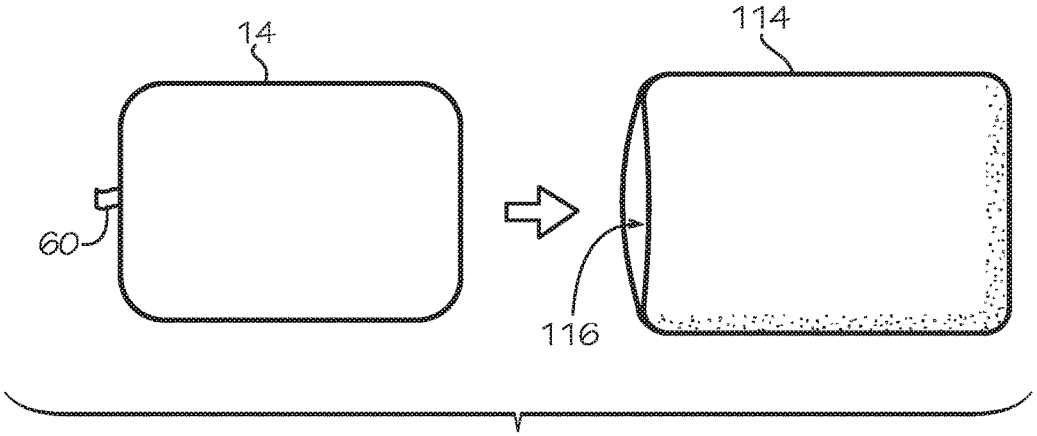
FIG. 4 illustrates a perspective view of an embodiment of a top pillow system in accordance with the present disclosure.
Figure 6:
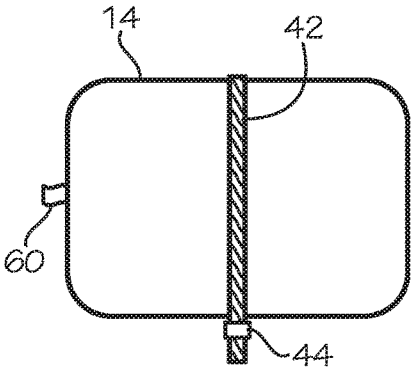
FIG. 6 illustrates a perspective view of an embodiment of a top pillow in accordance with the present disclosure.
Figure 8:
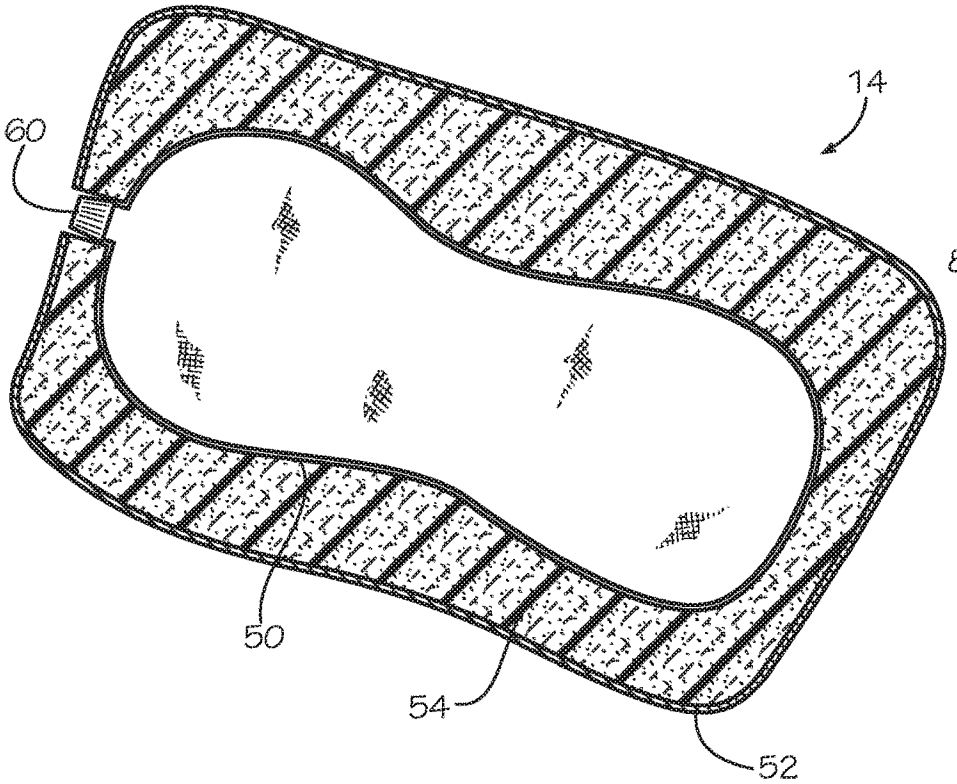
FIG. 8 illustrates a cross-sectional view of an embodiment of a top pillow in accordance with the present disclosure.
Figure 10:
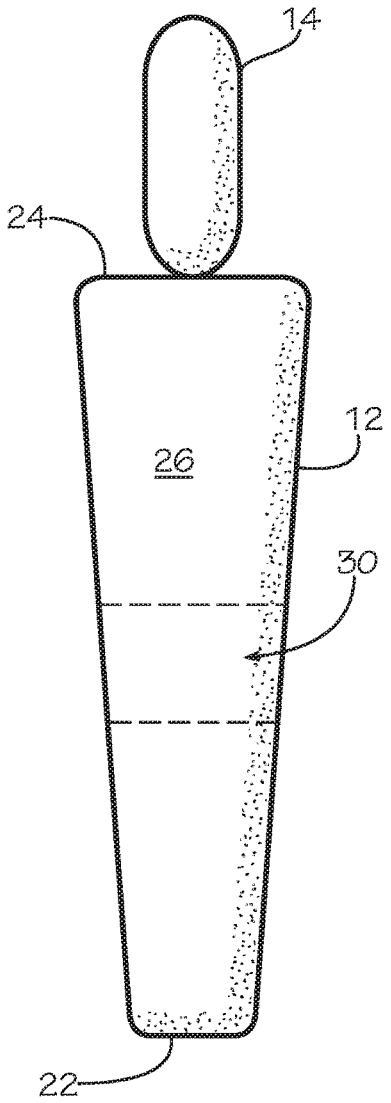
FIG. 10 illustrates a side view of an embodiment of an upright pillow system in accordance with the present disclosure.
Figure 22:
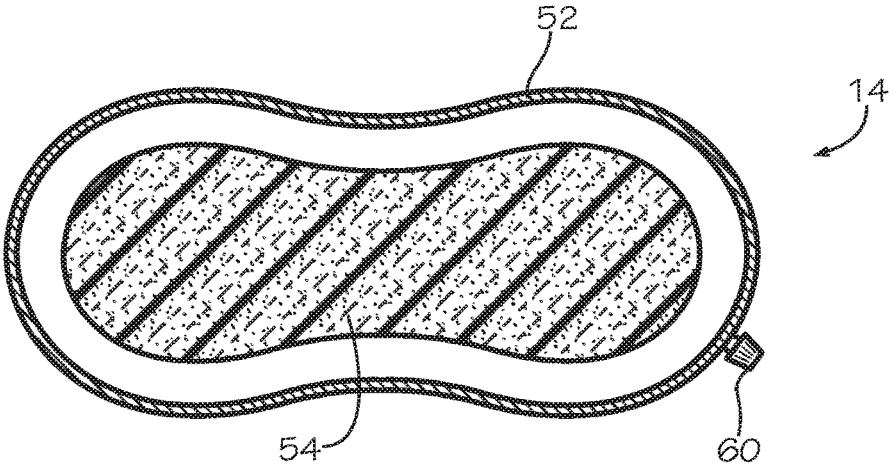
FIG. 22 illustrates a partial cross-sectional view of an embodiment of a top pillow in accordance with the present disclosure.

In some embodiments, top pillow 14 is fully or partially inflatable. This may be achieved by using an airtight chamber or bladder allowing a user to inflate and/or deflate top pillow 14 for storage or to provide a desired level of inflation for optimized comfort during use. A top pillow valve 60 is disposed on top pillow 14 in some embodiments as shown in FIGS. 4, 6 and 22 to allow inflation and deflation of the bladder portion of top pillow 14. Referring to FIG. 8, a cross-sectional view of an inflatable embodiment of a top pillow 14 is shown. Top pillow 14 includes a top pillow shell 52 surrounding a top pillow filler 54. An inflatable top bladder 50 is disposed in top pillow shell 52 surrounded by top pillow filler 54. Top pillow filler 54 includes any suitable filler material for providing comfort to a user, including but not limited to a foam material, an open-cell foam, a closed cell foam, a memory foam, textile material, beads, feathers, natural fibers, artificial fibers, or other suitable filler materials. Inflatable top bladder 50 includes a bow-tie shape in some embodiments, or may alternatively include other shapes such as a regular rectangular shape or the shape of an ellipsoid. Top valve 60 provides a way for a user to inflate or deflate inflatable top bladder 50. Top valve 60 includes any suitable valve such as a screw valve. In some embodiments, inflatable top bladder 50 includes a self-inflating bladder utilizing a self-inflating PVC valve of the types used with self-inflating mattress and self-inflating pads. During use, a user may open top valve 60, allowing the self-inflating feature of inflatable top bladder 50 to be activated. Once the self-inflating feature of inflatable top bladder 50 provides self-inflation, a user may provide additional inflation by blowing into top valve 60. A user may then close top valve 60 once a desired inflation level is reached. Referring back to FIG. 4, top valve 60 may be used when top pillow 14 is received in top pillow case 114 without removing top pillow 14 from top pillow case 114 due to the position of top valve 60 on the periphery of top pillow 14. Inflation may be achieved either manually by blowing into the valve, or using a mechanical or electrical pump coupled to the valve.

Referring further to FIG. 22, in some embodiments, the top pillow 14 includes an inflatable configuration. In this embodiment, top pillow 14 includes a bladder having a valve 60 for inflation. Top pillow shell 52 forms an airtight chamber that can be inflated or deflated by the user via valve 60. Top pillow shell 52 can include any suitable airtight material of the types used in inflatable devices. A top pillow case may be installed over top pillow 14 prior to or after inflation. In some embodiments, a top filler material 54 is disposed in top pillow shell 52 on top pillow 14. Top filler material 54 may include any compressible material to provide a self-inflating feature to top pillow 14. Top filler material 54 may include but is not limited to a foam material, an open-cell foam, a closed cell foam, a memory foam, textile material, beads, feathers, natural fibers, artificial fibers, or other suitable filler materials. During transport or storage, a user may open valve 60 and compress top pillow 14, thereby pushing the trapped air out of the top pillow shell 52 while simultaneously compressing top filler material 54. The user may then close valve 60 while top pillow 14 is in a compressed state, creating a vacuum to maintain the top pillow 14 in the compressed size. When a user wishes to use top pillow 14, the valve 60 may be opened allowing air to enter top pillow shell 52 while also allowing top filler material 54 to slightly expand.

Figure 5:
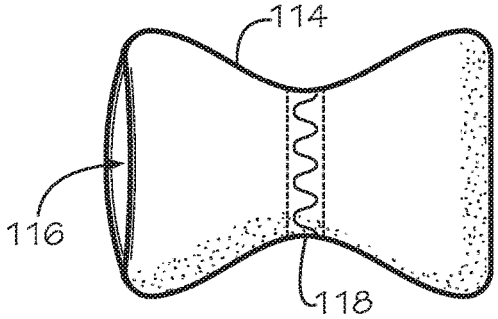
FIG. 5 illustrates an exploded view of an embodiment of a top pillow case in accordance with the present disclosure.
Figure 7:
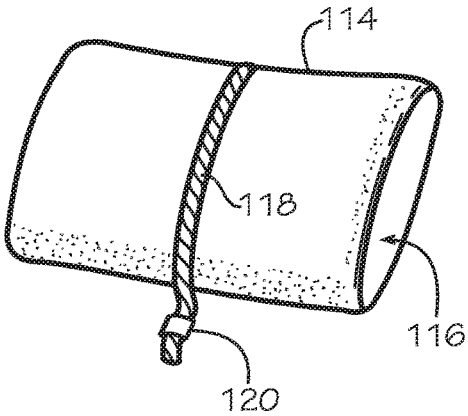
FIG. 7 illustrates a perspective view of an embodiment of a top pillow case in accordance with the present disclosure.

Referring further to the cinching feature on some embodiments of top pillow 14, cinch 42 may be disposed directly on top pillow 14 as shown in FIG. 6 or alternatively as a pillow case cinch 118 disposed directly on tip pillow case 114, as seen in FIG. 7. Cinch 42 includes a cinch lock 44 in some embodiments to secure cinch 42 at a desired engagement with top pillow 14. Additionally, pillow case cinch 118 in some embodiments may also include a pillow case cinch lock 120 to secure pillow case cinch 118 at a desired position. As shown in FIG. 5, in alternative embodiments, an integral pillow case cinch 118 is disposed internal to top pillow case 114 to provide a desired bow-tie shape to top pillow 14 when top pillow 14 is installed in top pillow case 114. Integral pillow case cinch 118 may include a resilient material such as an elastic band sewn into or otherwise disposed on top pillow case 114. Each embodiment of top pillow case 114 includes a top pillow case opening 116 positioned to receive the top pillow 14.

The interchangeability of top pillow case 114 allows a user to maintain a clean surface on top pillow 14 for cleanliness and comfort by changing out or reversing top pillow case 114 after use. Additionally, if a top pillow 14 is inadvertently dropped on the ground or other surface, the top pillow case 114 may be changed to a clean top pillow case. This interchangeability of the top pillow case 114 provides an advantage over conventional travel and medical pillows without such interchangeable features.

Figure 9:
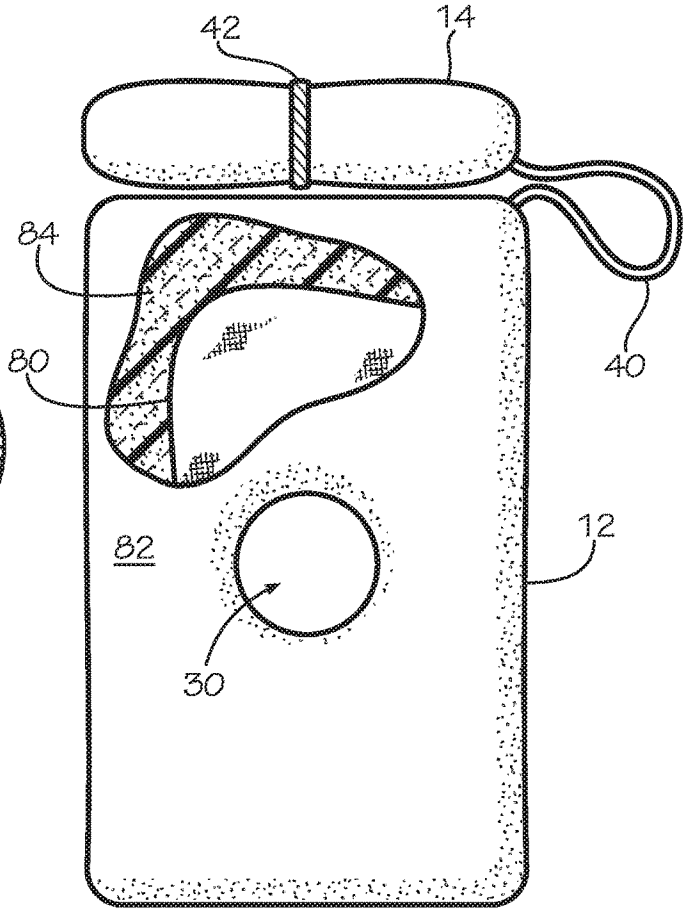
FIG. 9 illustrates a partial cut-away view of an embodiment of an upright pillow system in accordance with the present disclosure.

Referring to FIG. 9, in some embodiments, base pillow 12 also includes an inflatable configuration. For example, base pillow 12 may include a base shell 82 surrounding an inflatable base bladder 80. Inflatable base bladder 80 includes a self-inflating bladder utilizing a self-inflating PVC valve of the types used with self-inflating mattresses and self-inflating pads. Inflatable base bladder 80 includes a corresponding bladder passage surrounding the base passage 30 in some embodiments. A base filler 84 is positioned in the base shell 82 surrounding base bladder 80. Base filler 84 includes any suitable material for providing comfort to a user, such as but not limited to a foam material, an open-cell foam, a closed cell foam, a memory foam, textile material, beads, feathers, natural fibers, artificial fibers, or other suitable filler materials.

During use, a user may open the base valve on the base bladder 80, allowing the self-inflating feature of inflatable base bladder 80 to be activated. Once the self-inflating feature of inflatable base bladder 80 provides self-inflation, a user may provide additional inflation by blowing into the base bladder valve. A user may then close the base valve once a desired inflation level is reached.

Figure 23:
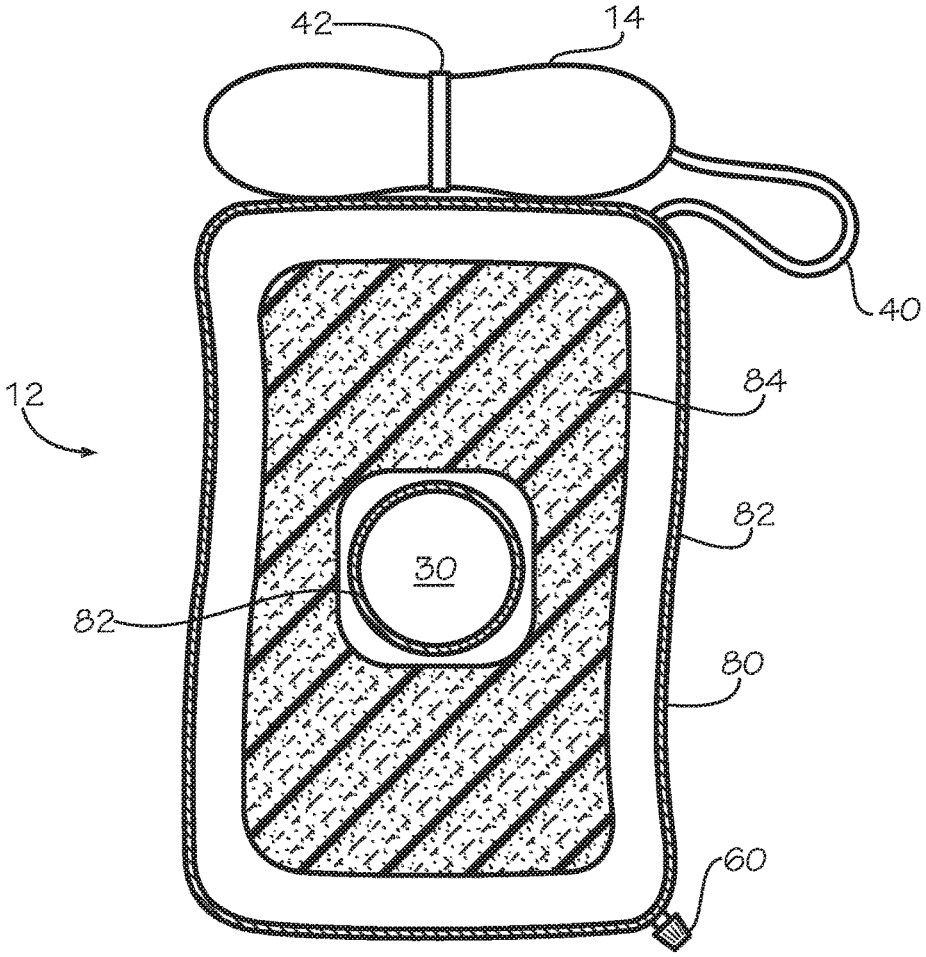
FIG. 23 illustrates a partial cross-sectional view of an embodiment of a base pillow in accordance with the present disclosure.

In other configurations, the entire base pillow 12 is inflatable, as shown in FIG. 23. Base pillow 12 includes an inflatable chamber defined by base shell 82 in some embodiments. Base shell 82 includes any suitable air-tight material for forming an inflatable pillow. A valve 60 is disposed on base shell 82 to allow a user to inflate or deflate base pillow 12. Base pillow 12 may be compressed in size to allow for a more compact form during travel or storage by releasing valve 60 and rolling or folding base pillow 12. In some embodiments, a base filler material 84 is disposed inside base shell 82 to provide a self-expanding function to the inflatable base pillow. As such, when valve 60 is opened, air may enter base shell 82 via valve 60 allowing base filler material 84 to expand slightly. Additionally, base filler material 84 may be provided to improve comfort and support of base pillow 12. Base filler material 84 may include any suitable material, including but not limited to a foam material, an open-cell foam, a closed cell foam, a memory foam, textile material, beads, feathers, natural fibers, artificial fibers, or other suitable filler materials.

Base pillow 12 may be used in a partially-inflated state or in a fully-inflated state. When base pillow 12 is used in a partially-inflated state, the overall form factor of base pillow 12 may not be well defined, allowing the base pillow 12 to conform to the body of a user or the surroundings of a travel or medical environment.

The base pillow 12 includes an interchangeable base pillow case 112, surrounding base pillow 12, as seen in FIG. 1. Base pillow case 112 provides an interchangeable cover for base pillow 12 to allow a user to have a clean surface on base pillow 12. Alternatively, a user may wish to change out the base pillow case 112 or top pillow case 114 to different cases having various materials, designs or patterns for decorative purposes, such as affiliations with sports teams, brands, advertising, or other content.

Alternatively, in some embodiments, a textured pattern, graphic design or other surface treatment may be applied directly onto the surface of base pillow 12 or top pillow 14 in some embodiments. Such treatment allows for customization of the base pillow 12 or top pillow 14 and may reduce the need for an additional pillow case. In addition, in some embodiments a user may use the base pillow standing alone, or the top pillow standing alone.

Figure 11:
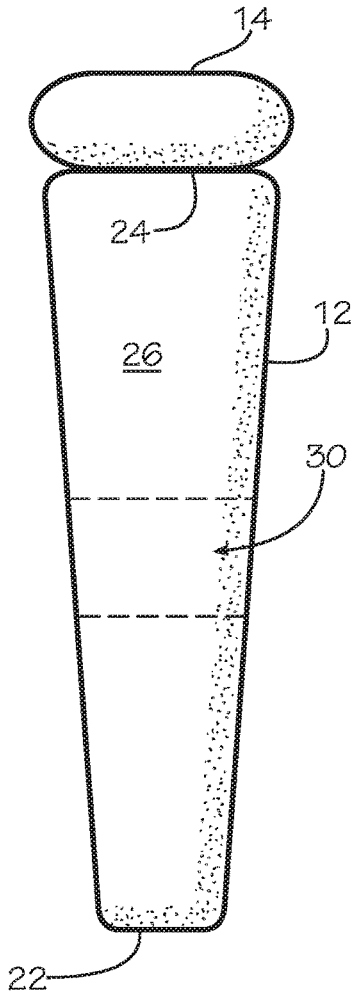
FIG. 11 illustrates a side view of an embodiment of an upright pillow system in accordance with the present disclosure.

Referring back to FIG. 9, top pillow 14 may be positioned against base pillow 12 in a number of different orientations. As seen in FIG. 9 and FIG. 11, top pillow 12 is positioned against base pillow 12 along its major surface lying flat. In alternative orientation, top pillow 14 may be positioned in an upright orientation relative to base pillow 112 to achieve a desired support for sleep. For example, FIGS. 12-21 illustrate numerous configurations of use for the upright sleep system 10 of the present disclosure. As shown in FIG. 12, a user in an airplane seat may position the base pillow 12 on or alongside the user's body on or between the user's leg 204 and the armrest 206. The lower base edge 22 of base pillow 12 fits between the user's leg 204 and the armrest 206. The base pillow 12 provides a platform for positioning the top pillow 14 such that the user may rest the user's head, neck or torso against the top pillow 14 while the top pillow 14 is simultaneously supported by the base pillow 12. As such, the upright sleep system 10 provides stable and comfortable apparatus for supporting a user's head, neck, face, chin, torso and arms in a travel or medical seating environment. To further increase comfort and stability, the user may also place his or her arm 200 through base passage 30 in base pillow 12.

Figure 13:
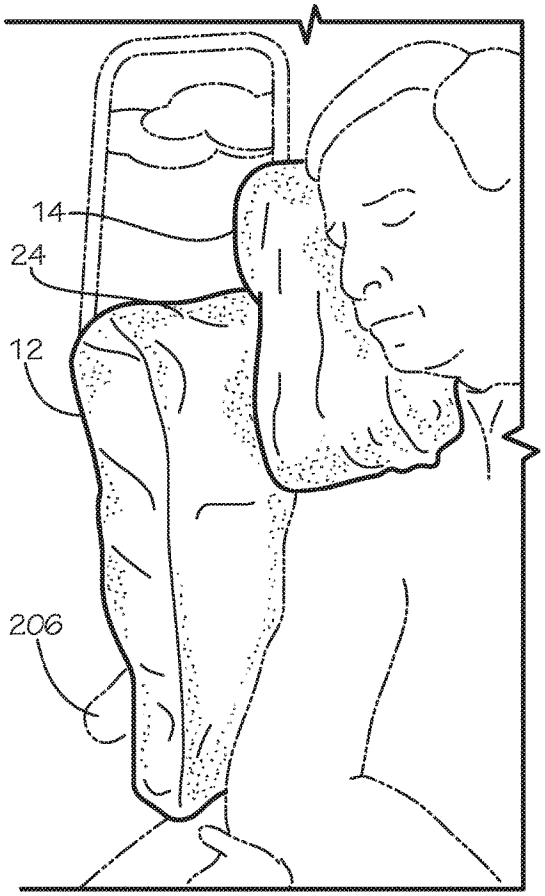
FIG. 13 illustrates a perspective view of an embodiment of an upright pillow system in use by a user in accordance with the present disclosure.

An alternative configuration is shown in FIG. 13, whereby a user may place the base pillow 12 against a wall of an airplane or an adjacent armrest 206 when sitting in a window seat. The user may then place the top pillow 14 against the upper base edge 24 on the base pillow 12, and the user may rest his or her head, neck or torso against the top pillow 14 in this position. As such, the base pillow provides a stable support for the top pillow 14, supporting both the top pillow 14 and the user's body while the user rests. This helps prevent the user from nodding his or her head while sleeping upright. As in all representations the user can choose whether they want arm(s) in our out of the base passage 30.

Referring to FIG. 14, an alternative configuration is shown providing the base pillow 12 positioned across a user's chest. The user's arms wrap around the base pillow, and one of the user's hands or arms 200 may extend into the base passage 30 to provide further support and comfort. The top pillow 14 in this configuration may be used behind the user's head, neck or torso in a conventional pillow placement or on top of the base pillow 12 with top pillow 14 under the chin. This configuration may be used in a variety of different seating environments including travel and medical applications.

Figure 15:
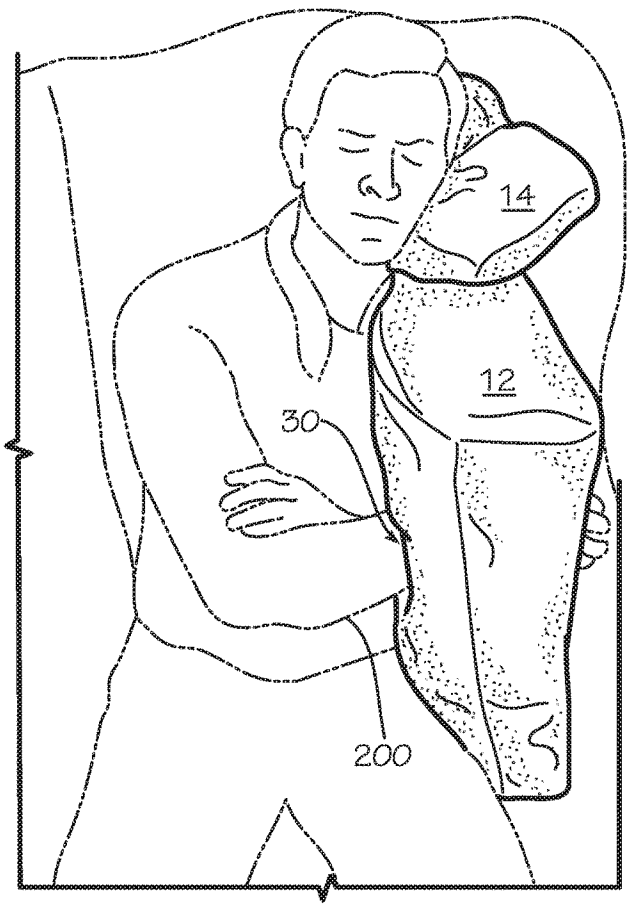
FIG. 15 illustrates a perspective view of an embodiment of an upright pillow system in use by a user in accordance with the present disclosure.

An additional configuration for the upright seating system is shown in FIG. 15. In this configuration, a user may sit in a seat or chair in an upright position with the base pillow 12 alongside the user's body or on top of their leg. The user's opposite arm 200 may be placed in the base passage 30. The top pillow 14 is located on the upper edge of the base pillow 12, and the base pillow 12 provides a stable platform for supporting the top pillow 14. The base pillow 12 is wedged in place against the user's body or on top of their leg, and the tapered shape of the base pillow 12 allows the base pillow 12 to fit against the user's lower body without being too bulky while simultaneously providing adequate support for the top pillow 14 and the user's upper torso and arms.

Figure 16:
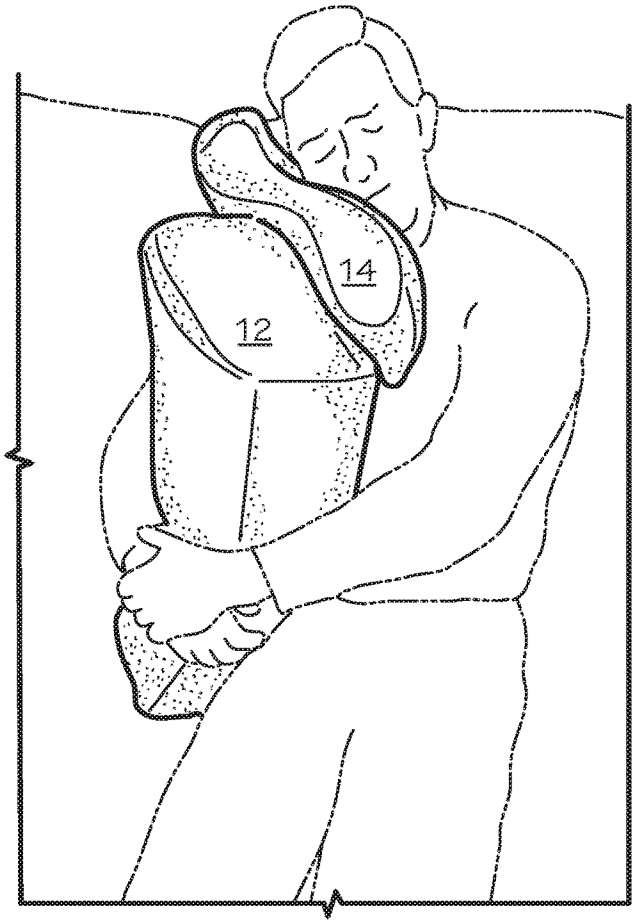
FIG. 16 illustrates a perspective view of an embodiment of an upright pillow system in use by a user in accordance with the present disclosure.

As seen in FIG. 16, in another configuration a user may wrap his or her arms around the exterior of the base pillow 12, while the top pillow 14 is placed between the user's head, neck or torso and the upper edge of the top pillow 14. The base pillow 12 thus acts as a stable platform to support both the user's head, neck, chin or torso and the top pillow.

Figure 17:
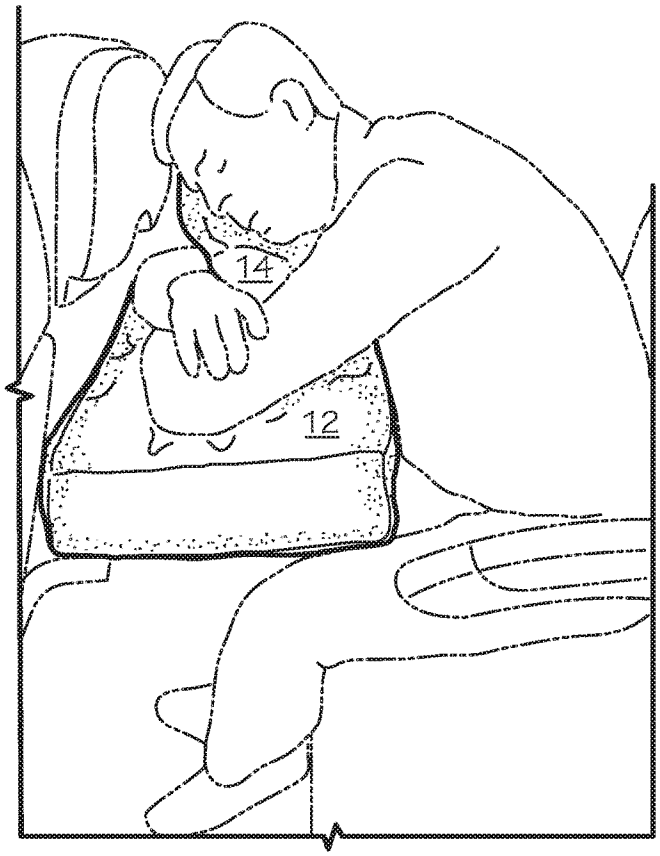
FIG. 17 illustrates a perspective view of an embodiment of an upright pillow system in use by a user in accordance with the present disclosure.

In yet another embodiments, shown in FIG. 17, a user may position the base pillow 12 across his or her lap in a travel or medical seating environment. Similarly, in this position, a user may place the base pillow 12 on a convertible tray table on the seatback in front of the user on an airplane. The base pillow 12 provides a cushioned base for the top pillow 14, which the user may adjust to provide a maximum level of comfort. The base pillow 12 remains relatively stationary in this position, and the user is free to move the top pillow to an optimal location for sleeping. In this position, plug 70 shown in FIG. 2 may be used to block base passage 30.

As seen in FIG. 18, base pillow 12 may also be used as a back support behind the user's torso, while the top pillow 14 is used to support the user's head, neck or torso. In this embodiment, top pillow 14 can rest against the upper edge of base pillow 12. To provide lumbar support, the base pillow may be flipped along its horizontal axis such that the thicker end is oriented down, and the more narrow end extends upwardly toward the user's head, neck or torso. The thickness and height of base pillow 12 may take many forms, and these parameters may be adjusted to accommodate users of different sizes.

Figure 19:
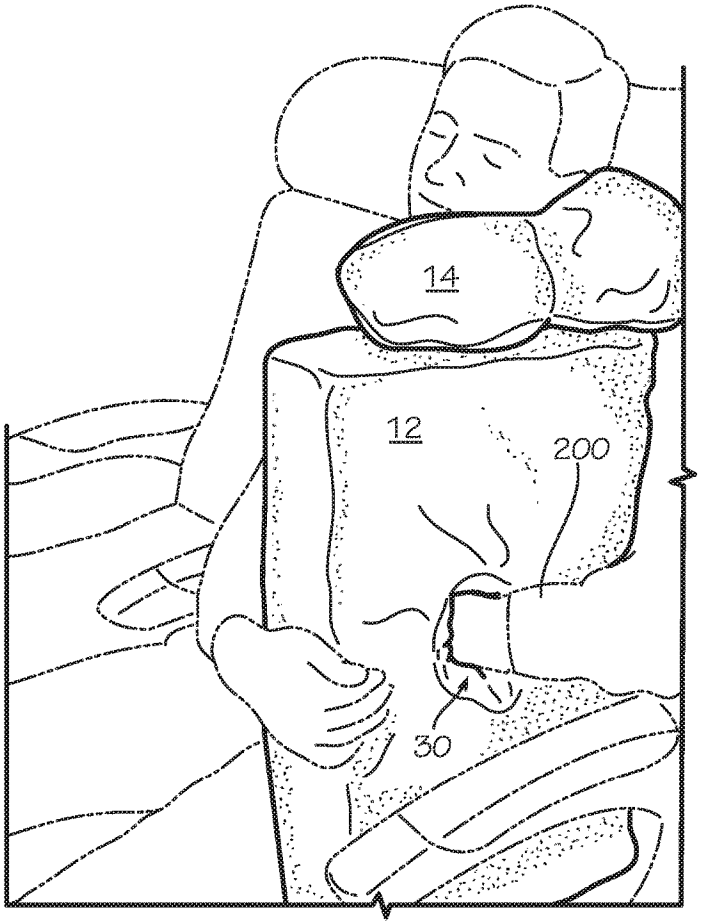
FIG. 19 illustrates a perspective view of an embodiment of an upright pillow system in use by a user in accordance with the present disclosure.

Referring to FIG. 19, in another embodiment, a user sitting in an aisle seat may place the base pillow 12 between the user's leg and an armrest on the seat. The user's arm on the same side as the base pillow 12 may extend around the side of the base pillow and into base passage 30. The user's opposite arm may reach around and grab the side edge of the base pillow 12. The top pillow 14 rests on the upper edge of the base pillow 12, thereby supporting the user's head, neck, chin or torso.

Figure 20:
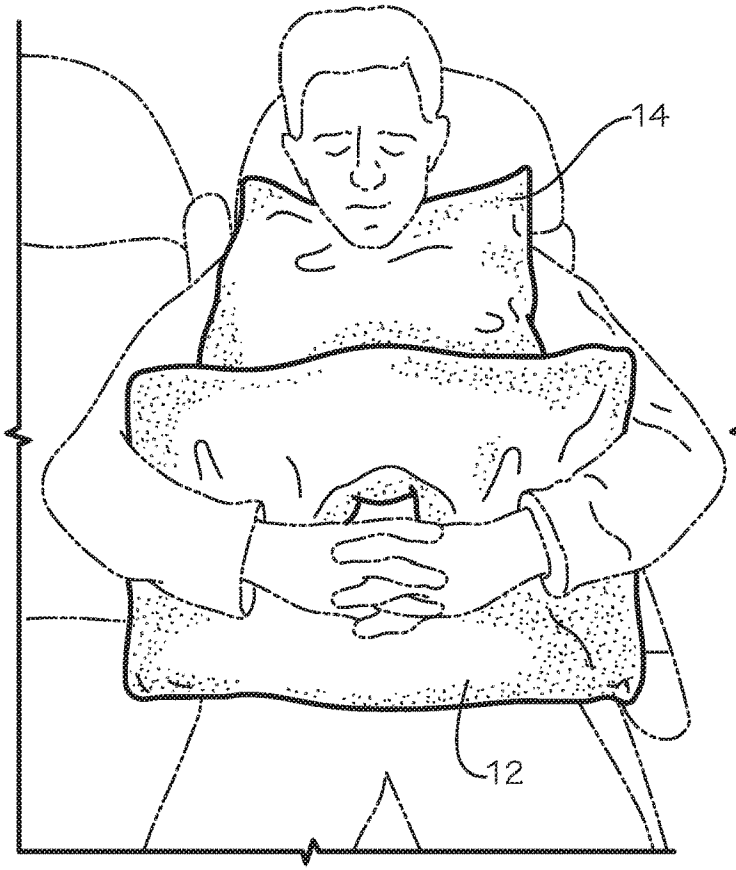
FIG. 20 illustrates a perspective view of an embodiment of an upright pillow system in use by a user in accordance with the present disclosure.

As seen in FIG. 20, an upright pillow system 10 may be positioned with a base pillow placed across a user's lap, and a top pillow resting against a side edge of the base pillow. The user's chin may rest on the top pillow while the top pillow is being supported by the side edge of the base pillow. This configuration allows a user to achieve support for the top pillow at a slightly lower elevation than if the top pillow were resting against the top edge of the base pillow.

Figure 21:
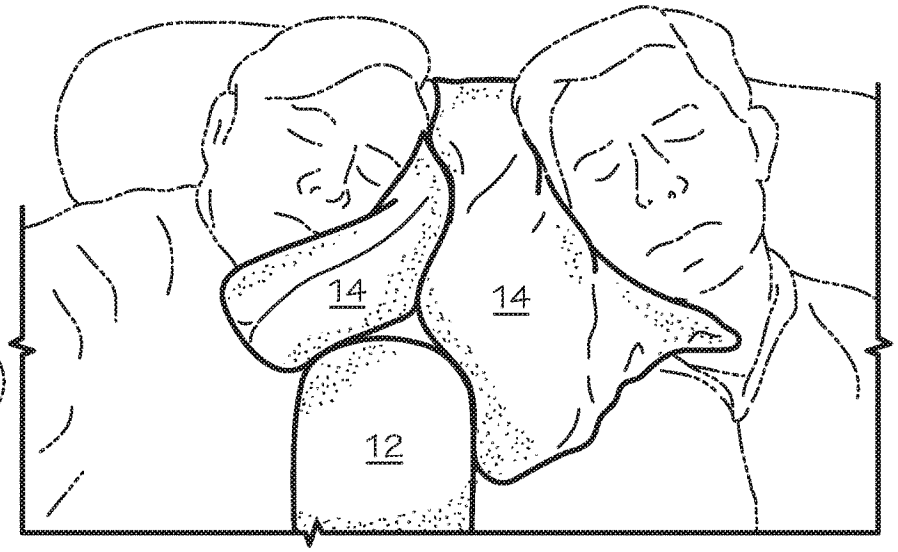
FIG. 21 illustrates a perspective view of an embodiment of an upright pillow system in use by multiple users in accordance with the present disclosure.

Referring to FIG. 21, an alternative configuration is illustrated showing a single base pillow supporting first and second top pillows. A base pillow is positioned between first and second users. A first top pillow associated with a first user is positioned against the upper edge of the base pillow, and a second top pillow associated with a second user is also positioned against the upper edge of the base pillow. The base pillow provides a support for both the first and second top pillows at the same time.

Numerous other configurations for the upright sleep system of the present disclosure may be realized when in use. The disclosed embodiments and configurations of the upright sleep system are presented only as examples, and are not intended to illustrate all possible embodiments and configurations for the apparatus.

Thus, although there have been described particular embodiments of the present invention of a new and useful Upright Sleep System, it is not intended that such references be construed as limitations upon the scope of this invention except as set forth in the following claims.

What is claimed is:

1. An upright sleep apparatus, comprising:

a compressible and inflatable base pillow having a top edge, a bottom edge, a first side edge, and a second side edge, the top edge having a top edge thickness and a top edge length, the bottom edge having a bottom edge thickness and a bottom edge length, the base pillow including a front pillow face and a back pillow face and a base pillow filler comprising a foam material disposed inside the base pillow, wherein the top edge thickness is approximately twice the bottom edge thickness, the first and second side edges include substantially the same shape, and the first and second side edges form a trapezoid shape, and wherein the top edge thickness is greater than the bottom edge thickness when the base pillow is inflated;

a substantially flat platform region defined on the top edge of the base pillow;

a top pillow in spaced relation to the base pillow, the top pillow shaped to rest against the platform region on the top edge of the base pillow; and a passage defined entirely through the base pillow from the front pillow face to the back pillow face, the passage providing an opening in the base pillow, and wherein in a first use configuration the top pillow rests against the platform region on the top edge of the base pillow and a user's arm extends through the base passage in the base pillow during use of the base pillow in the first use configuration;

a base valve on the base pillow;

a base shell on the base pillow surrounding the base pillow filler, wherein the base shell is an airtight material; and a tether having a first tether end secured to the base pillow and a second tether end secured to the top pillow.

2. The apparatus of claim 1, the top pillow further comprising a top pillow filler, wherein the top pillow is inflatable.

3. The apparatus of claim 2, wherein the top pillow filler comprises a foam.

* * * * *